United States Patent [19]

Alms et al.

[11] 3,932,119

[45] Jan. 13, 1976

[54] BAFFLES FOR GRAIN DRYER

[75] Inventors: Erhard E. Alms, Barrington; James E. Mitchell, Algonquin, both of Ill.

[73] Assignee: AFE Industries, Inc., Lake Zurich, Ill.

[22] Filed: June 20, 1974

[21] Appl. No.: 481,153

[52] U.S. Cl. ..... 432/101; 34/174; 432/222

[51] Int. Cl.[2] ..... F27D 1/00; F24H 1/00

[58] Field of Search ..... 432/101, 222; 34/174

[56] References Cited

UNITED STATES PATENTS

| | | | |
|---|---|---|---|
| 3,181,740 | 5/1965 | Andersen, Jr. | 34/174 |
| 3,239,960 | 3/1966 | Stevens | 432/222 X |
| 3,386,715 | 6/1968 | Alms | 432/222 |
| 3,561,740 | 2/1971 | Walker et al. | 432/222 |
| 3,636,638 | 1/1972 | Noyes | 34/174 |

*Primary Examiner*—John J. Camby

*Attorney, Agent, or Firm*—Hill, Gross, Simpson, Van Santen, Steadman, Chiara & Simpson

[57] ABSTRACT

A grain dryer is disclosed in which a blower forces air past a burner and then through a duct into a bin made of oppositely curved columns of grain defining between them and an end wall a plenum chamber for drying the grain in the bin. The invention resides in the use of a plurality of spaced baffles of particular configuration designed to take a stream of air of non-uniform pressure and temperature over a cross section of the stream, and transforming said stream into a stream in the plenum chamber of substantially uniform pressure and temperature over any cross section thereof, said stream, if desired, having a predetermined temperature gradient lengthwise of the bin which compensates for a lengthwise dryness gradient in the grain in the bin.

7 Claims, 7 Drawing Figures

BAFFLES FOR GRAIN DRYER

This invention relates to grain dryers, and particularly to a means for supplying heated air of uniform temperature and pressure to a dryer to effect uniform drying of the grain. For purposes of illustration, this invention will be described with reference to its use with batch type grain dryers.

It is a prime objective of commercial grain dryers to extract a predetermined quantity of moisture from a batch of grain in the shortest possible time consistent with uniformity of drying and preservation of the quality of the grain. The speed of the moisture extraction process depends upon moving large quantities of heated air over the grain so that as the air absorbs the moisture from the grain it is rapidly supplanted by dryer air. The quality of the grain is preserved by ensuring that the air moving over it is of uniform temperature and velocity.

The heated air for the drying process is derived from a blower which moves air rapidly from the exterior of the dryer past a burner located in a duct leading to the interior of the dryer. The air used to heat the grain therefore is a mixture of exterior air and products of combustion. It is desirable for reasons of economy of space and materials to make the duct as short as possible. The quantity of heated air required per unit time to effect the fastest drying of the grain in a duct of reasonable size, however, results in an air velocity past the burner in the range of 4,000 to 5,000 feet per minute. With a blower of the centrifugal type this velocity is too rapid to permit the air to mix so that the fuel will be completely burned and products thereof mixed with ambient air within the duct and prior to its entry into the plenum chamber in the dryer. For example, if the air were moving at 1,000 feet per minute, a duct 8 feet long would be required for evenness of temperature in the duct, and at 5,000 feet per minute a duct 40 feet long would be required which, of course, is impractical. If, on the other hand, an 8 foot duct is used with an air velocity of 5,000 feet per minute, a short flame would result and there would be a great unevenness of air velocities and air temperatures entering the drying bin to create undesirable hot spots which in turn would result in uneven drying and possible burning of the grain.

Other factors which influence the distribution of heated air over the cross section of a duct are the type of fan used to blow the external air into the duct and the shape and location of the burner in the duct. A radial bladed fan will cause a concentration of air around the periphery of the duct, and a centrifugal blower with double inlet will concentrate the air midway of the axial length of the blower and at the outside of the involute duct forming the exit of the blower. The burner is an obstruction in the duct which will deflect air passing therethrough in accordance with the shape of the burner.

In U.S. Pat. No. 3,386,715 to E. E. Alms dated June 4, 1968 there is disclosed one approach to the solution of the problem of uneven heat distribution in the air duct of a dryer. In this approach, the burner is placed in the entrance side of a blower, along with a baffle to limit the amount of air passing around instead of through the burner. The blower, being located downstream of the heated air, acts as a mixer to agitate the air so that the exit side of the blower produces a stream of uniformly heated air. The blower itself, however, introduces a variation in the velocity of the air over the cross section of the duct leading to the bin and results in an uneven distribution of heated air in the bin. Furthermore, the blower operates upon heated air which is less dense than cold air and hence moves a lesser mass or weight of air per unit time than it would if placed upstream of the burner.

Another approach to the solution of the problem of uneven heat distribution in the air is disclosed in U.S. Pat. No. 3,749,551 to E. E. Alms et al dated July 31, 1973 by which two separate blowers are used one above the other, both moving heated air into a common duct. Each influences one half of the air in the duct so that such concentration of the stream as occurs is broken up into two smaller concentrations. Although the result is an improvement over that produced by a single blower, the device of the patent is a space heater wherein the air velocities encountered are considerably less than those found in grain dryers. Such a dual blower construction would not eliminate unevenness in the distribution of heated air issuing from the duct when air velocities past the burner approach those used for drying grain.

It is an object of this invention to provide for controlling the flow and temperature of a stream of heated air moving into the plenum chamber of a batch type grain dryer so that rapid and substantially uniform drying of the grain will result.

Another object of this invention is to provide a controlled stream of heated air to the plenum chamber of a grain dryer which stream is produced by a fan, burner, and duct combination wherein a duct of minimum length is required for efficient utilization of the fuel.

As a specific object, this invention has within its purview the provision of a series of baffles spaced axially from one another in a duct, the function of the baffles being to interpose obstructions selectively to the stream of air flowing in the duct to make the velocity of the stream uniform and to promote complete combustion of the fuel in the duct prior to the entrance of the stream into the plenum chamber of a dryer connected to the outlet of the duct.

A more specific object of this invention is to provide a first baffle in a duct around a burner therein to compel movement of the air in the duct over the burner for complete heating of the air, a second baffle downstream from the first and at the point of maximum velocity of the stream to produce uniform movement of the stream through the duct, and a third baffle axially spaced downstream of the second baffle and at the entrance of the plenum chamber of the dryer to (a) further mix the products of combustion from the burner with the air from a blower, (b) retard the movement of the air into the dryer, and (c) deflect the air radially outwardly of the duct. A fourth baffle may or may not be required at the entrance to the plenum chamber if the outward shift of the air is greater than desired, and also if the mixing of the air and products of combustion is not deemed to be sufficient.

These and other objects of this invention will become apparent from the following detailed description of a preferred embodiment thereof when taken together with the accompanying drawings in which.

Figures 1, 2, 3, 4, 5, 6, 7:
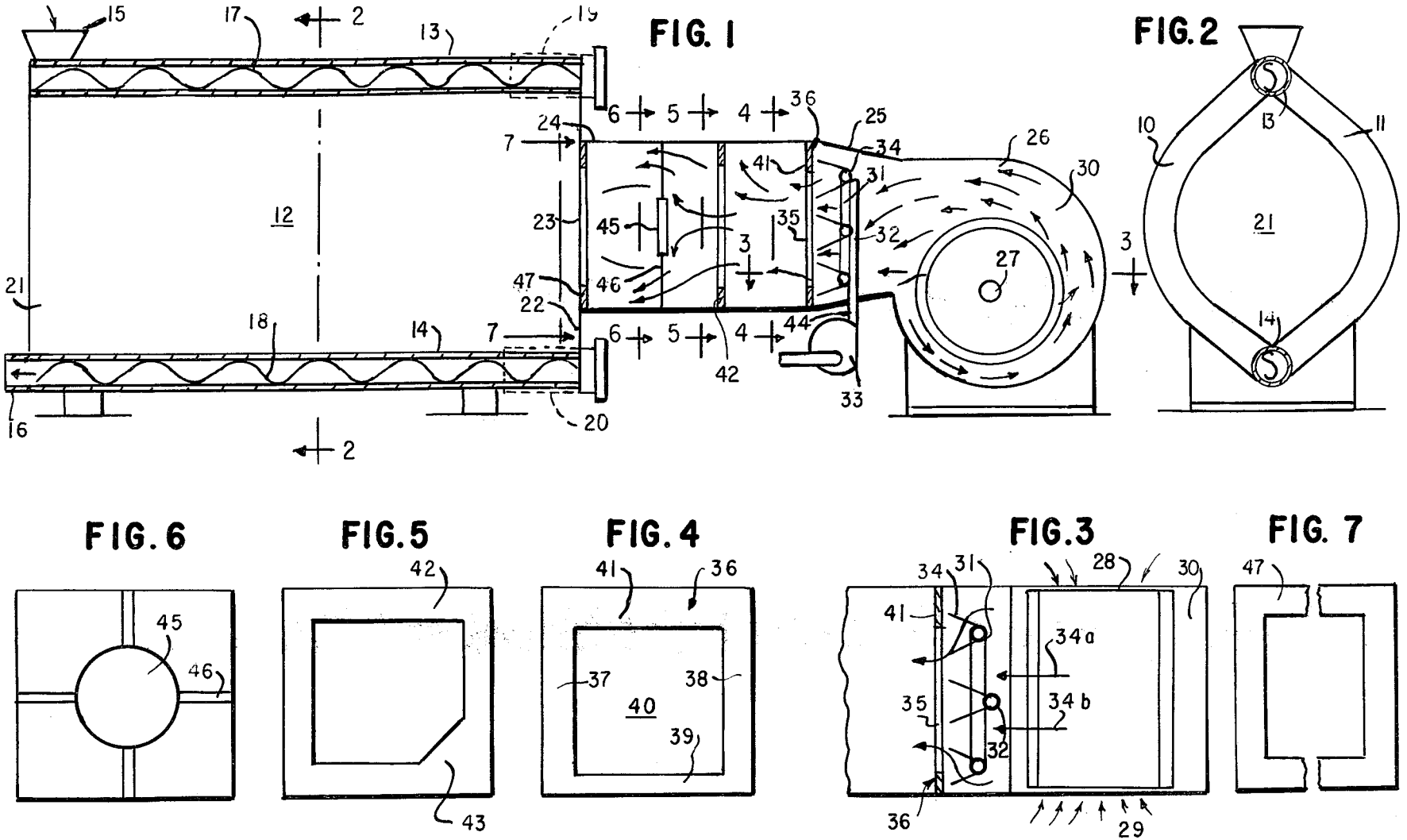
FIG. 1 is a side elevation in section of a batch type dryer incorporating this invention.
FIG. 2 is a transverse section through the dryer of FIG. 1 taken along line 2—2 thereof and looking toward the left in said FIG. 1.

FIG. 3 is a fragmentary plan view in section of the blower and duct taken along line 3—3 of FIG. 1; and FIGS. 4–7 are elevational views of the baffles of this invention, the view being taken in the direction of the arrows at the ends of the lines 4—4, 5—5, 6—6 and 7—7 of FIG. 1.

In its preferred form this invention comprises a duct having one end directed into the plenum chamber of a batch type grain dryer and its opposite end connected to the outlet from a centrifugal blower. A gas type burner having a general configuration corresponding to that of the duct is disposed at the entrance end of the duct. A first baffle having a perimeter engaging the interior wall of the duct is disposed at the downstream edge of the burner, the first baffle having transverse walls extending inward of the duct a predetermined distance to retard axial flow of the airstream at the perimeter of the duct and to deflect said perimeter flow inward of the duct into the path of the products of combustion of the burner. A second baffle, also of the perimeter type is disposed downstream of the first baffle and is shaped to direct any cool or high velocity segment of the stream created by the burner or its supports inwardly into the main stream. A third baffle, of the disc target type, is suspended in the middle of the duct downstream of the second baffle to retard and further mix the air with the products of combustion and to spread the stream to increase its cross-sectional area while decreasing its velocity as it enters the plenum chamber in the dryer. The size of the target baffle is influenced by the temperature gradient desired in the plenum chamber to compensate for variation in dryness of the grain lengthwise of the dryer. A fourth baffle, also of the perimeter type may be disposed downstream of the third baffle, the fourth baffle serving when necessary to control the velocity of the air entering the plenum chamber of the dryer.

Referring now to the drawings for a more detailed description of the invention, the dryer to which the invention has been applied, as shown in FIGS. 1 and 2, is comprised of a pair of oppositely curved bins 10 and 11 made of perforated walls and having common inlet ends 13 at the top and common outlet ends 14 at the bottom. Grain to be dried is introduced into the dryer from an inlet opening 15 at the top of the dryer appropriately connected to a source of grain to be dried (not shown) and the dried grain is removed through an opening 16 at the bottom of the dryer. An inlet auger 17 extends across the top of the dryer and moves incoming grain horizontally across the tops of the bins 10 and 11 as they are progressively filled from the inlet end of the dryer. An outlet auger 18 extends across common bottom openings of the bins 10 and 11 to move dried grain out of the dryer. Augers 17 and 18 are driven by motors 19 and 20 shown in dotted outline in FIG. 1. Suitable controls, such as those described in U.S. Pat. No. 3,056,214 to A. Andersen, Jr., dated Oct. 2, 1962 may be used to activate motors 19 and 20 for augers 17 and 18 in a predetermined sequence.

Chamber 12, the curved sides of which are defined by bins 10 and 11, is the plenum chamber of the dryer. One end of chamber 12 is closed by a wall 21 and the opposite end of said chamber is closed by a wall 22 in which is formed an opening 23 of the size and shape of a rectangular duct 24. Said duct is connected at its opposite end to a burner section duct 25 which, in turn, is connected to the rectangular outlet of a centrifugal blower 26. The shaft of the blower is shown at 27 and the two opposed inlet ends 28 and 29 of the blower are shown in FIG. 3. The involute outlet end is shown at 30, said outlet end terminating in a rectangular opening to which the similarly shaped inlet opening of burner section 25 is attached.

In burner section 25 is disposed a gas type burner 31 which may be comprised of a plurality of sections of drilled pipe connected together to form a grid having a generally rectangular frontal configuration. A gas inlet pipe 32 at the outlet of a burner control valve 33 supplies fuel to the burner 31. Air from blower 26 passes around each of the pipe sections through diverging perforated deflectors 34 secured to each section in a known manner.

In the dryer chosen to illustrate this invention the bins 10 and 11 are filled through the top opening 13 by the auger 17, the filling taking place progressively from left to right as viewed in FIG. 1. After the bins are filled and the burner is operative, the grain shrinks and in addition is shaken down by the normal vibration of the blower so that the upper ends of the bins may be empty. Make-up grain is then brought in by the auger, and as the make-up grain moves along the tops of the bins it becomes heated and partly dried so that a temperature and dryness gradient is formed in the grain in the direction of the burner.

It has been found that if the products of combustion and air passing through duct 24 are not modified in any respect, the burning of the gases continues in the bin and, due to the velocity of the stream from duct 24, the region of each bin adjacent the duct will be cooler than the region remote from the duct. This produces a non-uniformity of grain dryness within a batch which is undesirable. Although dried grain when stored tends to even itself out, i.e., moisture from the wetter grain will migrate to the drier grain, a true measure of the dryness of the grain coming from the dryer is more difficult to obtain when there are variations within a batch of grain.

Because of the characteristic construction of a centrifugal type blower, air will enter from opposite directions to create a central pressure zone as shown by the two arrows 34*a* and 34*b* in FIG. 3. Then as the air is given a circular motion about the center of shaft 27, centrifugal force will concentrate the air along the outer surface of the blower, the greatest air velocity and pressure will be at the top and center of the exit opening.

In the burner section 25, the products of combustion expand with heat and are mixed with the air from the outlet of the blower. The products of combustion are forced downward by the higher velocity and pressure of the air at the top and center of the exit opening so that a layer of relatively cold, fast moving air is formed along the top of the duct 24. A similar but shallower layer is formed along the sides and bottom of the duct because of the central location of the stream of burning gas. If this relatively unmixed stream of air and products of combustion were permitted to enter the plenum chamber 12 unmodified, the drying of the grain would be correspondingly non-uniform.

According to the present invention, a first correction of the stream is effected at the outlet end 35 of the burner section. The correction comprises a baffle 36 having an outer shape and size to fit over the edge of the opening and then extending inward as shown more clearly in FIG. 4. The sides 37 and 38 and bottom 39 of baffle 36 define three sides of an opening 40 which is approximately the size and shape of the outer profile of deflector 34 at the frontal or posterior portion of the burner 31. The top 41 of the baffle, however, is wider than sides 37 and 38 and bottom 39 so that top 41 extends well below the horizontal extension of the upper edge of burner 31. Baffle 36 is placed in close proximity to deflector 34 and thus blocks air moving along the outer regions of the duct 24, and creates retarding eddies and an inward flow of the cold air into the gases in the deflector and also into the central unburned gases and products of combustion. At the top, where the greatest velocity and pressure exist, baffle 36 is wider to cover a larger area, hence exerts a greater retarding force as well as inwardly directing the cold air into the central stream.

Combustion continues in duct 24 downstream of baffle 36 and the burning gases expand toward the perimeter of the duct. To promote further mixing and uniformity of temperature and velocity a second baffle 42 (FIG. 5) is provided downstream of baffle 36. Baffle 42, like baffle 36, is a perimeter baffle and is designed to deflect the stream of air and burning gas inward toward the center of the duct. It performs one additional function, however, in that it provides a means for correcting any non-uniformity not corrected by baffle 36. Thus it has been found that in the dryer, burner and fan combination chosen to illustrate this invention, a concentration or pressure is developed in the lower right hand corner of the duct as viewed in FIG. 5 and hence. To disperse this local high pressure segment of the stream, baffle 42 is formed with a gussett 43 extending across the corner of the opening defined by baffle 42. Said concentration results from the particular form of burner and pipes 44 used to conduct the fuel to the burner. The inward extent of the baffle 42 on all sides is otherwise uniform and of slightly less extent than sides 37, 38 and 39 of baffle 36.

A target baffle 45 is used downstream of baffle 42. Target baffle 45 is disposed in the center of the stream and is supported from the sides of the duct by relatively thin braces 46. The function of this baffle is similar to that of such baffles used in other burners where it breaks up the concentration of hot gases that is formed in the center of the duct by burner 31 and retards the movement of the products of combustion downstream. In the present environment, it also directs the stream of hot gases outward so that if no further downstream baffle is used, the gases as they pass into the bin section of the dryer, i.e., into the plenum chamber, are closer to the grain to be dried.

Where the target baffle 45, though effecting an improved mixture of the hot gases, introduces a concentration of flow of the mixed gases at the perimeter of the duct, the fourth baffle 47 may be used at the exit end 23 of duct 24, i.e., where the duct enters the plenum chamber 12. As shown in FIG. 7, baffle 47 is a perimeter baffle with substantially identical top, bottom and sides, but it may have instead a central opening which approximates the cross-section shape of plenum chamber 12.

Absolute uniformity of temperature and pressure of the gases in the plenum chamber 12 is not always desired. The method of operating the dryer may result in either a non-uniform wetness of the grain or in a non-uniform distribution or compactness resulting from foreign material in the grain such as fines. If the pattern of non-uniformity is known and predictable, baffles 36, 42, 45 and 47 may be used to provide a compensating non-uniformity in the distribution of the hot gases in plenum chamber 12. The location, shape and size of the baffles will determine the ultimate distribution of the gases in the plenum chamber.

By selecting the appropriate area of the target baffle 45, the temperature gradient in the hot gases entering the plenum chamber measured lengthwise of the chamber can be made to compensate for the temperature gradient of the grain in the bin. Thus a larger baffle will reduce the temperature gradient and a smaller baffle will increase the gradient. The velocity of the stream measured around the perimeter of the baffle 45 can be regulated, in turn, by the size and shape of perimeter baffles 36 and 42. The length of the flame in the duct and hence the uniformity of the gases in the plenum chamber can also be regulated by the shape and location of the baffles. Thus, if desired, a substantially straight-line increase can be produced in the temperature of the air as it moves through the bin toward the end wall of the plenum chamber remote from the duct. If the flow around target baffle 45 is still too peripherially oriented, a radially inward correction can be effected by baffle 47.

We claim:

1. In combination, a grain drying bin comprising a pair of oppositely curved columnar bins having a common feed opening at the top and a common discharge opening at the bottom thereof and defining the sides, top and bottom of a plenum chamber, a wall closing one end of the plenum chamber, a burner, a blower adjacent the burner and having a discharge opening communicating with the burner, and a duct surrounding the burner and connecting the burner outlet with the plenum chamber at the end thereof opposite the said wall, said blower providing air in the duct at different velocities over the cross section of the duct and at an average velocity producing a temperature differential lengthwise of the plenum chamber, baffle means in the duct selectively deflecting the air in the duct to create a predetermined pattern of temperature variation over the cross section of the duct whereby to produce a predetermined and different temperature differential in the plenum chamber from the front wall to the rear wall thereof, wherein said blower is disposed on the side of the burner remote from the plenum chamber and discharges air into said duct, said burner having a rectangular configuration, said baffle means comprising a first baffle disposed in the duct adjacent the burner and reducing flow of air adjacent said burner at locations where the air flow is a maximum, a second baffle disposed downstream of the burner and adjacent the walls of the duct to deflect peripheral air inward of the duct, and a third baffle disposed centrally of the duct and downstream of the second baffle to deflect the central air stream radially outwardly, said baffles mixing the heated air from the burner with the air from the blower while retarding the flow of the mixed air whereby to provide a stream of air to the drying bin having the aforesaid predetermined and different temperature differential in the plenum chamber, wherein said blower is a centrifugal blower having a rectangular outlet, said duct is rectangular and connected to the rectangular outlet of the blower, said centrifugal blower having opposed inlet openings through which air is drawn by the blower in directions transverse to the general axis of the duct, said air, upon passing through the blower entering the duct with a maximum velocity at the outer central region of the rectangular outlet, and said first baffle reducing flow of air at said outer central region, and said first baffle comprising a substantially flat sheet extending across said duct and having a rectangular opening therein conforming in size, orientation and configuration to the size, orientation and rectangular configuration of the burner except for the outer central region of the duct corresponding to the outer central region of the rectangular blower outlet at which point the baffle extends inward to block a portion of the flow from said burner.

2. The combination defined in claim 1, wherein said feed opening at the top of the bin comprises a longitudinal chamber extending along the top of said bin, said chamber having an opening at one end thereof and an auger extending across said opening and through said longitudinal chamber for feeding grain to be dried along the top of said bin, said grain becoming progressively dryer as it proceeds through the said longitudinal chamber and thus requiring a compensating temperature gradient in the air passing through the bin, and said baffles producing said required compensating temperature gradient in the air passing through the bin.

3. The combination defined in claim 2, wherein said gradient comprises a substantially straight line increase in temperature as the air moves through the bin toward the end wall.

4. The combination defined in claim 1, there being a fourth baffle at the end of the duct downstream of the third baffle to deflect peripheral air inward of the duct.

5. The combination defined in claim 1, said second baffle comprising a substantially flat sheet extending across said duct and having a rectangular opening therein conforming in size, orientation and configuration to the size, orientation and configuration of the burner, said burner having an area of less resistance to the stream from the burner at one corner of the duct, and said baffle having a gusset extending across a corner of the opening therein downstream of said area of less resistance.

6. In combination, a grain drying bin comprising a pair of oppositely curved columnar bins having a common feed opening at the top and a common discharge opening at the bottom thereof and defining the sides, top and bottom of a plenum chamber, a wall closing one end of the plenum chamber, a burner, a blower adjacent the burner and having a discharge opening communicating with the burner, and a duct surrounding the burner and connecting the burner outlet with the plenum chamber at the end thereof opposite the said wall, said blower providing air in the duct at different velocities over the cross section of the duct and at an average velocity producing a temperature differential lengthwise of the plenum chamber, baffle means including first, second and third baffles in the duct selectively defelcting the air in the duct to create a predetermined pattern of temperature variation over the cross section of the duct whereby to produce a predetermined and different temperature differential in the plenum chamber from the front wall to the rear wall thereof, said first baffle comprising a substantially flat sheet extending across said duct and having a rectangular opening therein conforming in size, orientation and configuration to the size, orientation and rectangular configuration of the burner except for the outer central region of the duct corresponding to the outer central region of the rectangular blower outlet at which point the baffle extends inward to block a portion of the flow from said burner, said second baffle comprising a substantially flat sheet extending across said duct and having a rectangular opening therein conforming in size, orientation and configuration to the size, orientation and configuration of the burner, said burner having an area of less resistance to the stream from the blower at one corner of the duct, and said second baffle having a gusset extending across a corner of the opening therein downstream of said area of less resistance, and said third baffle comprising a disc and means supporting said disc substantially in the center of said duct in transverse relation thereto.

7. The combination defined in claim 6, said combination including a fourth baffle downstream of the third baffle and substantially at the entrance to the plenum chamber, said fourth baffle being a perimeter baffle and comprising a substantially flat sheet having a centrally located rectangular opening conforming in shape to the shape of the duct.

* * * * *